US007186074B2

(12) United States Patent
Blatchford et al.

(10) Patent No.: US 7,186,074 B2
(45) Date of Patent: Mar. 6, 2007

(54) AXIAL FLOW STREAM TURBINES

(75) Inventors: David Paul Blatchford, Rugby (GB); Richard Martin Bridge, Leicester (GB); Philip David Hemsley, Rugby (GB); Alan Hesketh, Northampton (GB); Adrian Lord, Rugby (GB)

(73) Assignee: Alstom Technology, Ltd., Baden (CH)

( * ) Notice: Subject to any disclaimer, the term of this patent is extended or adjusted under 35 U.S.C. 154(b) by 51 days.

(21) Appl. No.: 10/846,891

(22) Filed: May 13, 2004

(65) Prior Publication Data

US 2004/0253100 A1 Dec. 16, 2004

(30) Foreign Application Priority Data

May 13, 2003 (GB) ..... 0311008.7
May 13, 2003 (GB) ..... 0311009.5

(51) Int. Cl.
*F01D 11/08* (2006.01)
*F01D 11/00* (2006.01)
*F01D 11/12* (2006.01)

(52) U.S. Cl. ..... 415/100; 415/103; 415/136; 415/173.3; 415/173.5; 415/173.6; 415/173.7; 415/174.2; 415/174.5; 415/230; 415/231; 277/347; 277/355; 277/412; 277/413; 277/416; 277/418

(58) Field of Classification Search ..... 415/100–103, 415/136, 138, 139, 173.1, 173.3, 173.5, 173.6, 415/173.7, 174.2, 174.5, 230–231; 277/347, 277/355, 409, 411–413, 416, 418
See application file for complete search history.

(56) References Cited

U.S. PATENT DOCUMENTS 1,415,571 A * 5/1922 Junggren ..... 415/136
1,722,721 A * 7/1929 Wait ..... 415/136
2,080,425 A * 5/1937 Lysholm ..... 415/138
2,211,874 A * 8/1940 Wilson ..... 415/202
2,282,894 A * 5/1942 Sheldon ..... 415/137
2,556,890 A * 6/1951 Thorn ..... 415/136
3,107,084 A * 10/1963 Conrad, Sr. et al. ..... 415/103
3,314,651 A 4/1967 Beale
3,501,246 A * 3/1970 Hickey ..... 415/174.2
3,876,330 A 4/1975 Pearson et al.
4,112,582 A 9/1978 Beckershoff (Continued)

FOREIGN PATENT DOCUMENTS

DE 1140945 A * 12/1962 ..... 415/173.6

(Continued)

*Primary Examiner*—Christopher Verdier
(74) *Attorney, Agent, or Firm*—Darby & Darby

(57) ABSTRACT

A drum-type rotor carries an annular row of moving blades having root portions held within a slot in the periphery of the rotor. A turbine casing surrounds the rotor and carries a static blade assembly with an annular row of static blades which, together with the annular row of moving blades, constitutes an impulse turbine stage. The static blade assembly has a radially inner static ring confronting a periphery of the rotor with a seal acting therebetween. The static blade assembly has an outer static ring which has a substantially greater thermal inertia and stiffness then the inner static ring and is capable of sufficient radial sliding relative to the casing so as to accommodate relative thermal expansion and contraction of the outer static ring and the turbine casing.

13 Claims, 6 Drawing Sheets

U.S. PATENT DOCUMENTS

| | | | | | |
|---|---|---|---|---|---|
| 4,362,464 | A | * | 12/1982 | Stock | 415/136 |
| 4,840,537 | A | * | 6/1989 | Silvestri, Jr. | 415/136 |
| 5,024,581 | A | * | 6/1991 | Foucher | 415/191 |
| 5,125,794 | A | | 6/1992 | Detanne | |
| 5,547,340 | A | * | 8/1996 | Dalton et al. | 415/173.6 |
| 5,997,249 | A | * | 12/1999 | Bell | 415/173.5 |
| 6,068,443 | A | | 5/2000 | Aoki et al. | |
| 6,131,910 | A | * | 10/2000 | Bagepalli et al. | 277/355 |
| 6,318,728 | B1 | * | 11/2001 | Addis et al. | 277/355 |
| 6,435,514 | B1 | * | 8/2002 | Aksit et al. | 277/355 |
| 6,439,844 | B1 | * | 8/2002 | Turnquist et al. | 415/173.3 |
| 6,692,228 | B2 | * | 2/2004 | Turnquist et al. | 415/174.2 |
| 6,722,846 | B2 | * | 4/2004 | Burdgick | 415/173.5 |
| 6,860,718 | B2 | * | 3/2005 | Suzuki et al. | 415/173.5 |

FOREIGN PATENT DOCUMENTS

| | | | | |
|---|---|---|---|---|
| DE | 25 32 537 | | 7/1984 | |
| DE | 43 02 633 | | 8/1994 | |
| DE | 44 25 353 | | 1/1996 | |
| DE | 44 46 361 | | 6/1996 | |
| JP | 61-250304 | A * | 11/1986 | 415/174.2 |
| SU | 167 1908 | | 8/1991 | |

* cited by examiner

AXIAL FLOW STREAM TURBINES

Priority is claimed to United Kingdom Patent Application No. GB 0311009.5, filed on May 13, 2003, and to United Kingdom Patent Application No. GB 0311008.7, filed on May 13, 2003. The entire disclosure of both applications is incorporated by reference herein.

This invention relates to axial flow steam turbines that include one or more stages of the impulse type.

BACKGROUND

Steam is supplied to a turbine at high pressure and temperature from a boiler and the energy in the steam is converted into mechanical work by expansion through the turbine. The expansion of the steam takes place through a series of static blades or nozzles and moving blades. An annular row of static blades or nozzles and its associated annular row of moving blades is referred to as a turbine stage. After the steam has been expanded in a high pressure (HP) turbine, it is conventional to return it to the boiler for re-heating and then to return the steam to an intermediate pressure (IP) turbine, from which the steam exhausts through one or more low pressure (LP) turbines.

An impulse turbine stage is one in which all or most of the stage pressure drop takes place in the row of static blades. The steam jet produced does work on the rotor of the turbine by impinging on the following row of moving blades, which are aerodynamically designed to provide a low reaction. In practice, impulse stages are designed with a small pressure drop over the moving blades (e.g. 5–20% degree of reaction, which is the percentage of the stage enthalpy drop taken over the moving blades).

A reaction turbine stage is one in which a substantial part (e.g. roughly half or more) of the stage pressure drop takes place over the row of moving blades. For example, reaction blading may be designed with a 50% degree of reaction, which gives approximately equal pressure ratios over the static and moving rows.

In a turbine with impulse blading, it is conventional to use a disc-type rotor, the static blade assemblies constituting diaphragms that extend into chambers between the rotor discs. The diaphragms extend radially inwards to a small diameter, for efficient sealing against the rotor due to the smaller leakage flow area.

In a turbine with reaction blading, the pressure drop over the static blade assembly is considerably less than over the static blade assembly of an impulse stage, and it is conventional to use a drum-type rotor. An outer static ring of the static blade assembly is radially keyed to the turbine casing so as to move with the casing. The moving blades have root portions carried within slots in the periphery of the drum.

FIG. 1 of the accompanying drawings shows a known type of disc and diaphragm arrangement. A turbine rotor 1 comprises a series of discs 2 with annular chambers 3 between them. Each disc 2 carries an annular row of moving blades 4, each having a root 6 fixed to the disc 2 by pins 7. The static blade assembly or diaphragm 8 which is immediately upstream of the disc 2 (with respect to the steam flow direction indicated by the arrows 9) comprises an annular row of static blades 11 extending between a radially outer static ring 12 and a radially inner static ring 13. The outer ring 12 is housed in and axially located by the turbine casing 14 and has an axial extension 16 carrying a fin-type labyrinth seal co-operating with the shrouds 18 of the moving blades 4. In this instance, the labyrinth seal comprises an axial series of circumferentially extending strips 17 whose hooked ends are caulked into an axial extension 16 of the outer static ring. The inner ring 13 (which is more massive than the outer ring 12) is accommodated in the chamber 3 between two discs 2 and carries a fin-type labyrinth seal 19 restricting the leakage flow (indicated by arrows 21) past the diaphragm 8. In this instance, the labyrinth seal 19 comprises an axial series of circumferentially extending, alternately longer and shorter triangular- or knife-section fins that extend from the seal carrier towards sealing lands on the rotor surface. The seal carrier itself is segmented to allow the seal 19 to have a limited degree of self-adjustment in the radial direction.

FIG. 2 of the accompanying drawings shows a known type of turbine with a drum-type rotor 22, the diameter of the periphery 23 being substantially constant. Each annular row of moving blades has the root portions 26 of the blades fixed in circumferentially extending slots in the rotor 22. As in FIG. 1, the shrouds 27 of the moving blades 24 are again sealed to the turbine casing 28 by fin-type labyrinth seals. In each annular row of static blades 29, an outer shroud portion of each blade is individually mounted in a circumferential slot in the casing 28 as shown. Their inner shroud portions are provided with inner fin-type labyrinth seals 32 adjacent the periphery 23 of the rotor 22. A disadvantage of this arrangement is that the outer shroud portions move with the casing 28 as it expands and contracts.

SUMMARY OF THE INVENTION

An object of the present invention is to provide a turbine construction that combines the advantages of both types of prior art steam turbines.

The present invention provides an axial flow steam turbine comprising:

(a) at least one impulse turbine stage having an annular row of static blades extending between a radially outer static ring and a radially inner static ring and an annular row of moving blades provided with blade root portions;

(b) a drum-type rotor, the blade root portions of the moving blades being held in peripherally extending slots of the rotor drum;

(c) sealing means acting between the inner static ring and the rotor drum;

(d) a turbine casing surrounding the turbine stage, the outer static ring being axially located in a recess in the turbine casing and having greater thermal inertia and greater stiffness than the inner static ring and being capable of limited radial movement relative to the turbine casing, thereby to accommodate out-of-round distortion of the turbine casing relative to the outer static ring.

The above-mentioned limited radial movement of the outer static ring relative to the turbine casing may be achieved by cross-key location of the outer static ring within the turbine casing.

The at least one impulse turbine stage may be combined with at least one reaction turbine stage on a common drum-type rotor, the impulse and reaction stages having the same inner diameter of their turbine flow annulus and the drum rotor having the same, or substantially the same, outside diameter along its axial length.

The at least one impulse turbine stage may follow a control stage that is an impulse turbine stage, the control stage comprising at least one steam inlet passage for directing steam onto an annular row of moving blades, and valve means for controlling the flow of steam into the turbine.

Further aspects of the invention, and advantages to be gained from its implementation, will be apparent from a perusal of the following description and claims.

BRIEF DESCRIPTION OF THE DRAWINGS

The invention will be described further, by way of example only, with reference to the accompanying drawings, in which.

DETAILED DESCRIPTION

Figure 3A:
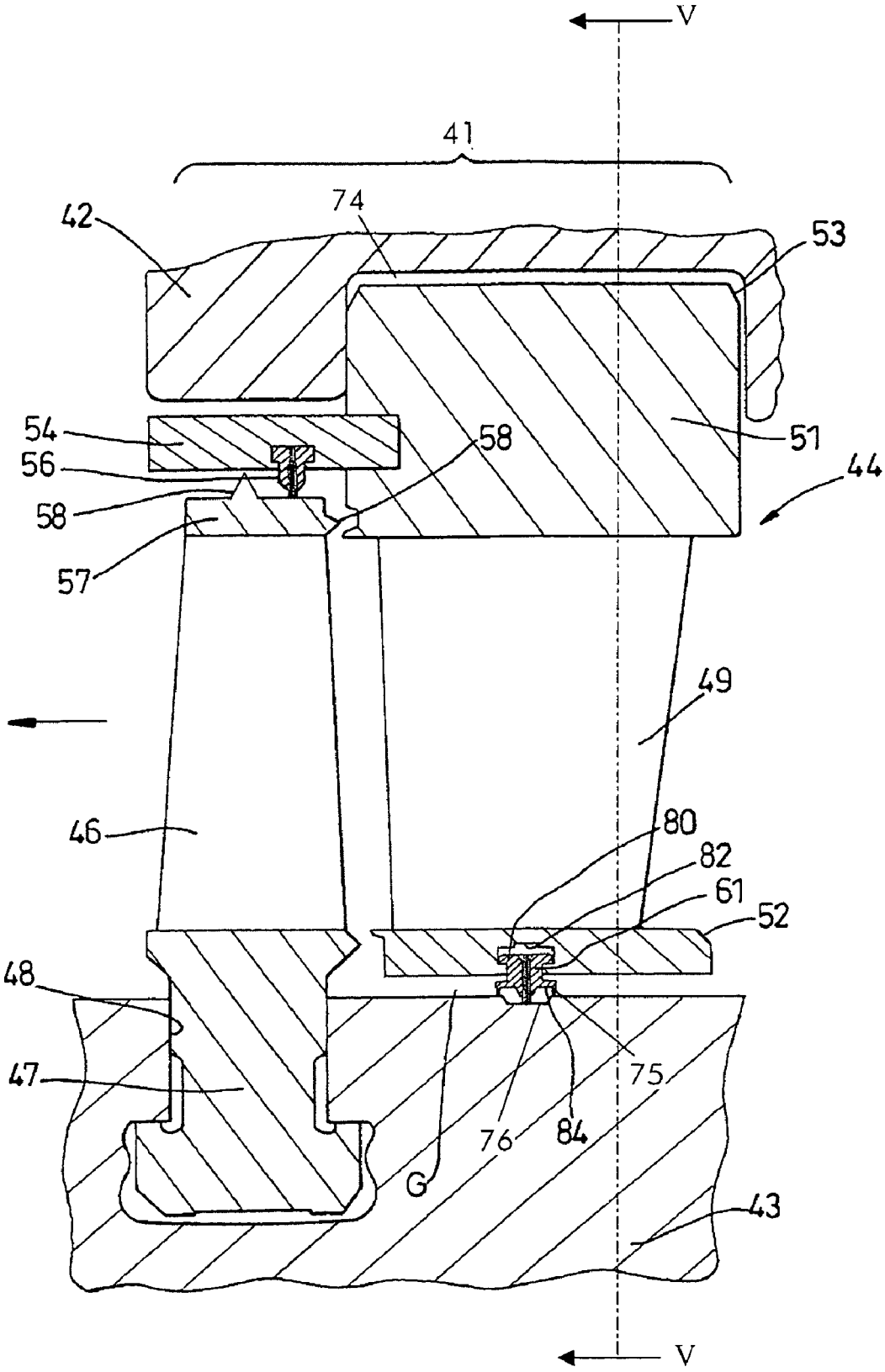
FIG. 3A is a partial axial section through an impulse turbine stage of a steam turbine in accordance with the present invention.

Referring to the drawings, FIG. 3A shows an impulse turbine stage 41 which is one of a plurality of such stages in a steam turbine comprising a turbine casing 42 surrounding a drum-type rotor 43. The turbine stage 41 comprises a static blade assembly 44 upstream of an annular row of moving blades 46 having root portions 47 held within a slot 48 in the periphery of the rotor 43. The static blade assembly 44 comprises an annular row of static blades 49 extending between a radially outer static ring 51 and a radially inner static ring 52, the radially inner side of which confronts the periphery of the rotor 43. Both rings 51 and 52 are segmented as necessary for manufacture, assembly and operation of the turbine.

The outer static ring 51 is housed in an annular chamber 53 which is formed in the casing 42 and is open towards the rotor 43, so that the outer ring 51 is axially located by the casing 42 but can move to a limited extent in the radial direction. The outer ring has a high thermal inertia and a high stiffness, in comparison with the inner ring 52, and is capable of sufficient sliding relative to the casing 42 in a radial sense to accommodate thermal expansion and contraction of the casing 42 and the outer ring 51 relative to each other. An advantage of this is that the static blade assembly 44 is not subject to distortion if the casing 42 distorts. This enhances the maintenance of concentricity between the inner ring 52 and the rotor 43 and the sealing of the inner ring with respect to the rotor.

Figure 5A:
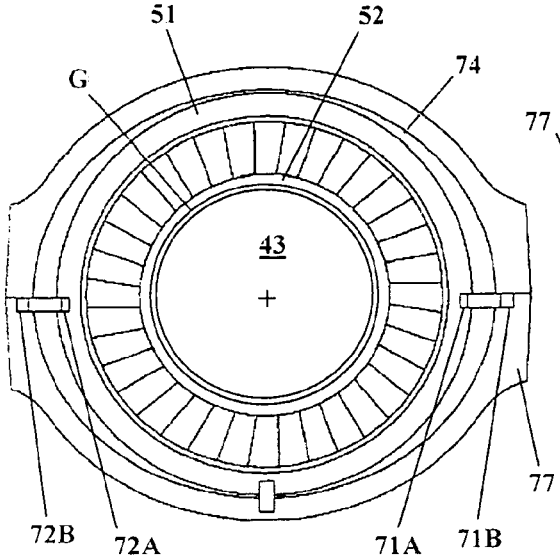
FIGS. 5A and 5B are diagrammatic radial cross-sections taken on line V—V in FIG. 3A, showing isolation of the static blade assembly from distortion of an exterior casing of the turbine.
Figure 5B:
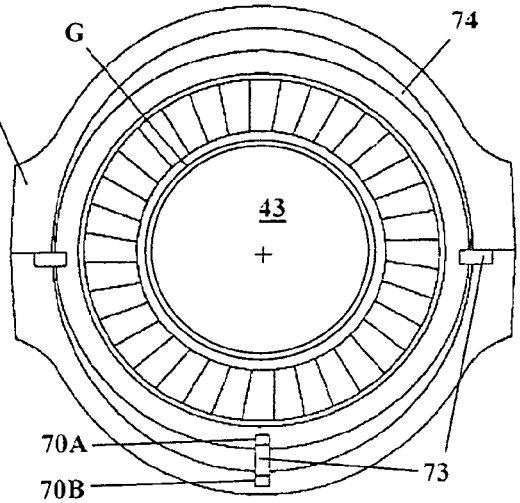

FIGS. 5A and 5B illustrate in an exaggerated manner how the outer static ring 51 is enabled to slide relative to the casing 42 in a radial sense, so avoiding distortion even if the outer turbine casing 42 becomes distorted. FIG. 5A shows out-of-round lateral distortion of the casing 42 and FIG. 5B shows out-of-round vertical distortion. The outer static ring 51 is provided with three axially extending slots or keyways 70A, 71A and 72A, which confront corresponding keyways 70B, 71B and 72B in the outer casing 42. One pair of keyways 70A and 70B is located at the lowest part of the outer ring 51 on its vertical centreline, whereas keyway pairs 71A, 71B and 72A, 72B are diametrically opposed to each other on the horizontal centreline. Keys 73 are housed in the keyways and extend across the annular gap 74 between the casing 42 and the ring 51. In this way, the outer static ring 51 is cross-key located within the outer turbine casing 42 and thereby substantially isolated from non-circularity of the casing.

Figure 6:
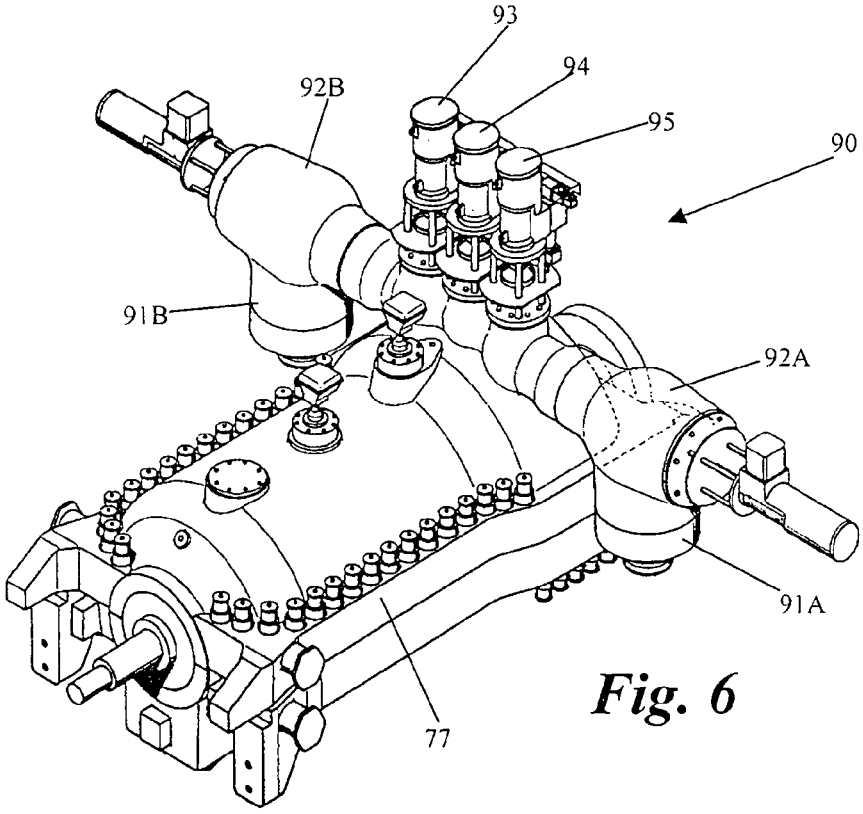
FIG. 6 is a pictorial external view of a steam turbine external casing and steam valve arrangement suitable for use with the present invention.

It should also be mentioned that as indicated in FIG. 5, outer casing 42 is made of two semi-circular halves, which are bolted together at external flanges 77, see also FIG. 6.

The static blade assembly 44 remains circular due not only to the above-described cross-key location of the outer static ring 51, but also due to its strength. Ring 51 is made of two massive semi-circular halves, which are normally bolted together to form an axi-symmetric structure with high circular stiffness. The inner static ring 52 may be segmented in order to help prevent temperature differences between the inner and outer static rings distorting the assembly. In addition, or alternatively, the radially thick outer ring 51 may be thermally matched with the radially thinner inner ring 52, i.e., they are designed so that their rates of thermal expansion and contraction are sufficiently similar to substantially avoid distortion of the static blades 49 as the turbine heats up and cools down during its operating cycles. The ability of the outer static ring 51 to maintain circularity of the whole impulse stage assembly, as described above, enables the bulk and stiffness of the inner static ring to be considerably reduced in comparison with conventional impulse stages employing a diaphragm and chamber type of construction. This gives advantages in turbine construction as explained later.

The outer ring 51 carries an axial extension 54, which in turn carries a seal 56. In this example, seal 56 is a brush seal, but other types of seal could be used, such as fin-type seals. This seal 56 contacts an outer moving shroud ring 57 attached to the tips of the moving blades 46. Furthermore, the shroud ring 57 has triangular- or knife-section fin-type sealing portions 58 which project towards the downstream side of the outer static ring 51 and the radially inner side of the extension 54 respectively.

An efficient annular seal 61, segmented as necessary, acts to minimise leakage of the turbine working fluid through the gap G between the inner static ring 51 and the periphery of the rotor 43. An outer flanged portion 80 of the seal 61 is held within a re-entrant slot 82 in the underside of the inner static ring 52. A radially inner portion 84 of the seal 61 projects from the slot 82 to sealingly engage the rotor drum. Being segmented, the annular seal 61 can slide radially in or out of the slot 82 to a limited extent to accommodate differential thermal growth between the rotor 43 and the inner static ring 52. The seal 61 may be a seal with multiple rigid sealing elements, such as a fin-type labyrinth seal, a seal with flexible sealing elements, such as a brush, foil, or leaf, or a combination of these two types of seal, such as a brush seal combined with a labyrinth seal comprising triangular- or knife-section fins 75, as shown.

In the embodiment of FIG. 3A, the bristles of the brush seal contact the rotor 43 in a shallow annular track 76 in the periphery of the rotor. In combination with the labyrinth seal component 75 of the seal 61, this provides a sinuous leakage path—and therefore reduced leakage—for turbine working fluid which escapes from the turbine annulus and passes through the gap G.

Figure 3B:
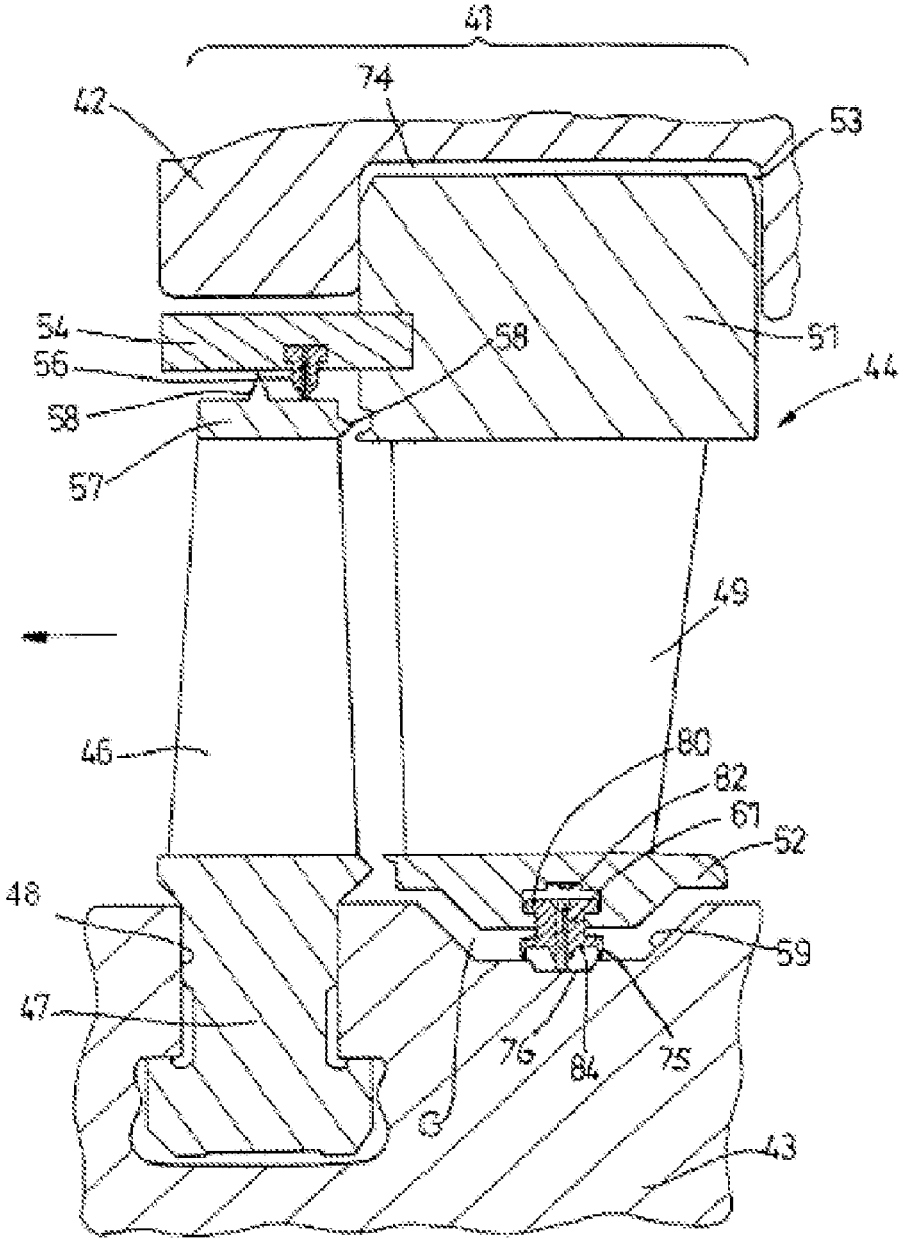
FIG. 3B is a view similar to FIG. 3A, but showing an alternative embodiment of the invention.

Referring now to FIG. 3B, this shows an alternative embodiment in which those components that are similar or identical to those shown in FIG. 3A are given the same references and will not be described again. The major difference of FIG. 3B from FIG. 3A is that the part of the periphery of the rotor 43 confronting the inner ring 52 has an annular recess 59, the axial ends of which are spaced from each of the adjacent rows of moving blades 46 (only one of which is shown). The annular recess 59 provides a significantly reduced-diameter drum portion over part of the axial distance between adjacent rows of moving blades. As shown, the inner static ring 52 is somewhat more massive in this embodiment as compared with FIG. 3A (though much less massive than a traditional diaphragm construction), and part of its radially inner side projects into the annular recess 59, thereby providing a constricted and radially stepped or sinuous leakage path for turbine working fluid which escapes from the turbine annulus and passes through the gap G between the underside of the static ring 52 and the outside of the rotor 43. As previously mentioned in connection with bristle track 76, such a stepped or sinuous leakage path increases its resistance to passage of the turbine working fluid therethrough.

As has already been said, annular recess 59 provides a significantly reduced-diameter drum portion, but it is here emphasised that unlike the conventional diaphragm-type of steam turbine construction, the radial depth of the annular recess 59 is less than the depth of the slot 48, preferably substantially less, e.g., the annular recess 59 may be approximately ¾, ⅔, ½, ⅓, ¼, or even less than ¼ of the depth of the slot 48. In this particular embodiment, it is a little less than ¼ of the depth of the slot. Various design criteria will be used to decide whether to incorporate one or more recesses 59 into the drum rotor 43, and if so, how deep to make each recess. One criterion may be the desired strength and rigidity of the inner static ring 52. Another criterion may be the degree of thermal matching that is considered desirable between the outer and inner static rings 51, 52 to avoid distortion of the blades 49 during working conditions in the turbine. This criterion will affect the dimensions and mass of the inner static ring.

An advantage of the arrangement of FIG. 3B is that the annular recess 59 is formed by removing low stressed and therefore redundant material from the drum periphery between the rows of moving blades without hazarding blade retention, while providing increased sealing efficiency due to the reduced drum diameter. Furthermore, the provision of the annular recess 59 enables the radial extent of an efficient seal 61 to be accommodated wholly or partly within the outer envelope of the drum-type rotor 43.

Figure 4:
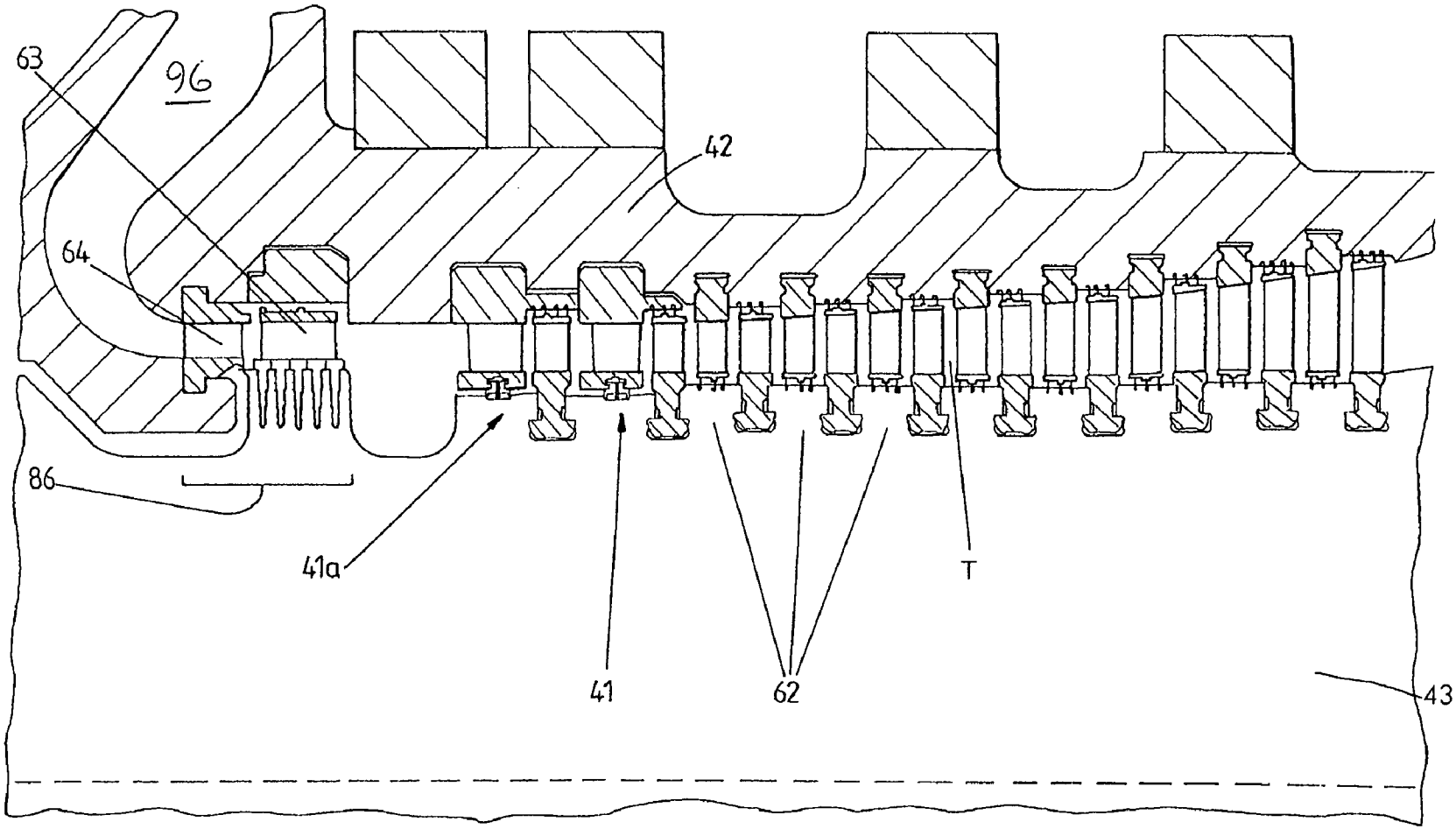
FIG. 4 is a partial axial section through an embodiment of a steam turbine incorporating the turbine stage shown in FIG. 3A.

FIG. 4 shows a high pressure steam turbine incorporating an impulse turbine stage 41 as described in FIG. 3A above, preceded by a similar turbine stage 41*a* and followed by a series of reaction turbine stages 62. All these stages have the same constant inner diameter of the turbine passage annulus T throughout their axial extent, aiding cheapness of manufacture due to commonality of dimensions.

Figure 1:
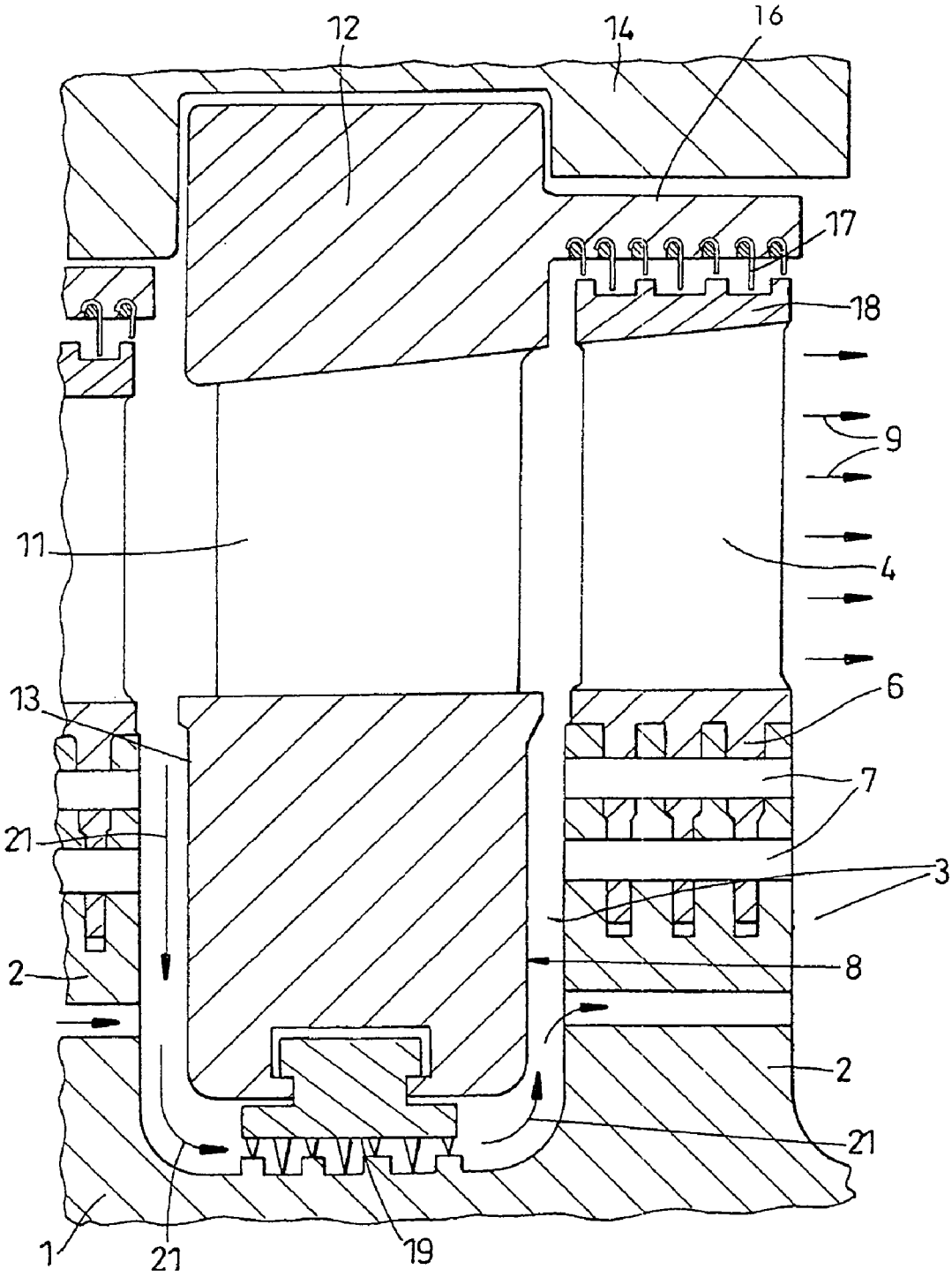
Fig. 1 (Prior Art)
FIG. 1 is a partial axial section through one known type of impulse steam turbine.
Figure 2:
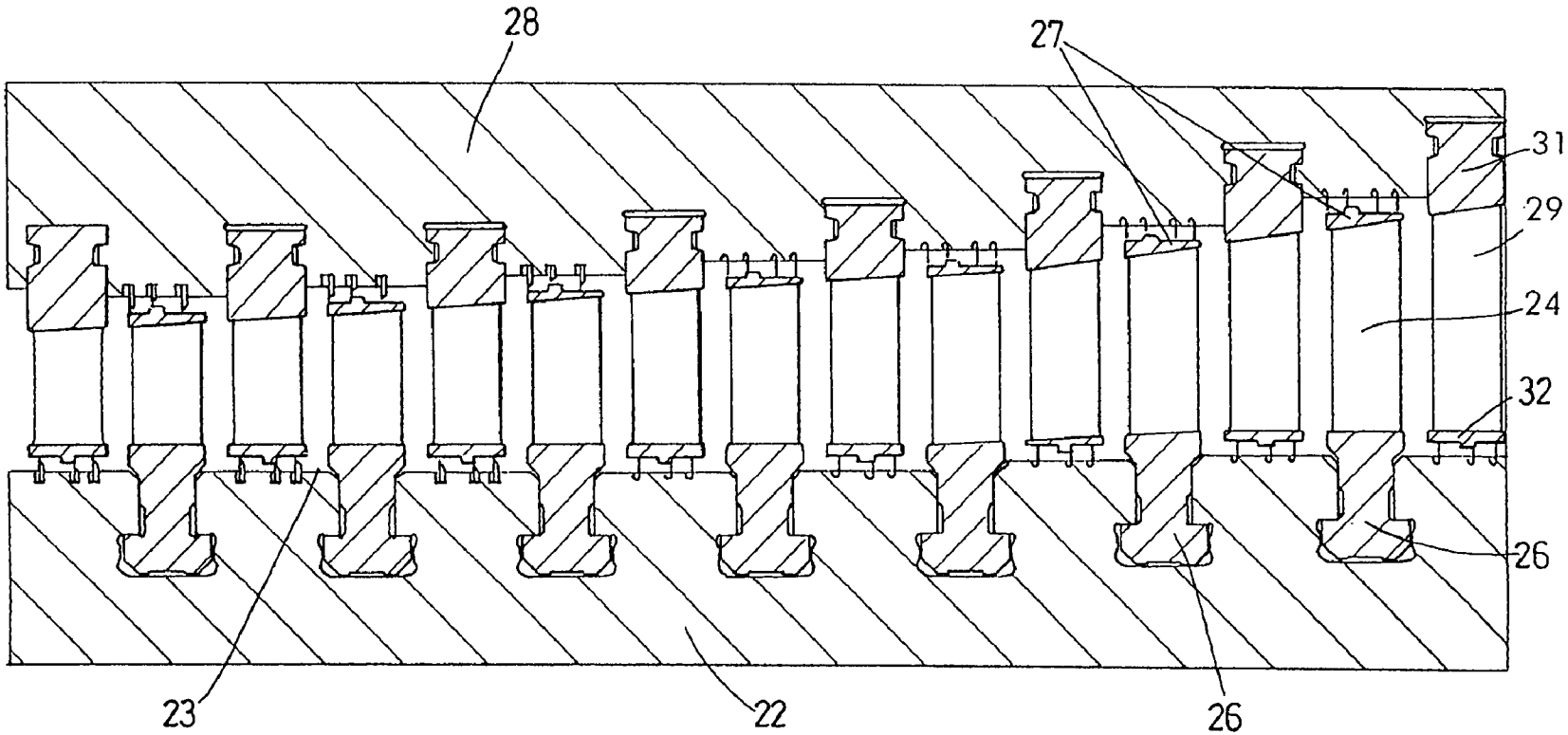
Fig. 2 (Prior Art)
FIG. 2 is a partial axial section through a known type of reaction steam turbine.

Considered in isolation from the impulse stages 41 and 41*a*, the reaction stages 62 are substantially as previously described in relation to FIG. 2. However, it should be noted that because the inner static rings of the impulse stages are less massive and bulky than those in the diaphragms usually required for such stages, both the impulse and reaction stages are able to share the same drum-type rotor, the diameter of the drum adjacent the inner static rings of the impulse stages as shown in FIG. 4 being only slightly less than (i.e., substantially the same as) the diameter of the drum adjacent the inner static rings of the reaction stages. Furthermore, if a configuration like that of FIG. 3B were to be used for stages 41*a* and 41, exactly (rather than substantially) the same outer drum diameter could be maintained as between the two types of stages if desired, with the inner static shrouds and their associated seals being at least partially housed in the annular recesses provided in the drum 43.

Referring again to FIG. 4, the turbine stages 41*a*, 41, 62 follow a control stage 86. The control stage 86 has moving impulse blading 63 and a steam inlet comprising static nozzle blades 64 preceding the moving blades 63. The control stage is further provided with a valve assembly 90 (FIG. 6) which controls the flow of steam through the nozzle passages between the nozzle blades 64, and hence through the row of impulse blading 63.

As indicated in FIG. 6, steam enters the turbine through supply lines 91A, 91B, which are provided with master valves 92A, 92B to turn the total high pressure steam supply on or off, or to throttle it. Three smaller valves 93, 94, 95 are also provided to control steam input to three different steam inlet passages, one of which, 96, is shown in FIG. 4. These steam inlet passages supply corresponding circumferentially extending sectors of the control stage 86, i.e., a top sector shown in axial section in FIG. 4, and two side sectors.

Note with respect to FIG. 4 that the impulse stages 41*a* and 41 are placed first in the series of stages downstream of the control stage 63 because they are more robust than the reaction stages and therefore better able to withstand the effects of the high pressure steam and any temperature and aerodynamic stresses imposed by differential admission of steam into the three sectors of the control stage. To ameliorate the effects of such differential admission around the circumference of the turbine, a radially and axially extending equilibration chamber separates the rest of the high pressure turbine from the control stage.

It should be noted that in the global market for heavy-duty steam turbines, customers often have a clear preference for turbine constructions of the conventional impulse diaphragm type. The reasons for this, as compared with conventional reaction (drum-type) designs, include:

reduced deterioration of clearances due to the greater stiffness of diaphragms, ease of on-site clearance adjustments, since these can be done one turbine stage at a time, and reduced maintenance costs due to both of the preceding factors and due to easy repair and refurbishment of components.

On the other hand, drum-type high reaction turbines have advantages such as reduced costs of original material and manufacture, combined with a more compact design to maximise power density. The present invention helps to combine the advantages of both types of prior art steam turbines.

What is claimed is:

1. An axial flow steam turbine comprising:

(a) at least one impulse turbine stage having an annular row of static blades extending between a radially outer static ring and a radially inner static ring and an annular row of moving blades provided with blade root portions;

(b) a rotor drum having a plurality of peripherally extending slots, the blade root portions of the moving blades being held in the peripherally extending slots;

(c) a sealing device acting between the inner static ring and the rotor drum; and (d) a turbine casing surrounding the impulse turbine stage and having a recess, the outer static ring being axially located in the recess and having greater thermal inertia and greater stiffness than the inner static ring, the outer static ring being capable of a limited radial movement relative to the turbine casing so as to thereby accommodate an out-of-round distortion of the turbine casing relative to the outer static ring, wherein the rotor drum includes an annular recess axially spaced from the peripherally extending slots and having a radial depth less than that of the peripherally extending slots, wherein the sealing device extends into the annular recess so that a radial extent of the sealing device is disposed at least partly within an outer envelope of the drum rotor, and wherein a radially inner portion of the inner static ring projects into the annular recess.

2. The axial flow steam turbine as recited in claim 1, wherein the at least one impulse turbine stage includes a further annular row of moving blades, wherein the annular row of static blades lies between the annular row of moving blades and the further annular row of moving blades, and wherein the annular recess is axially spaced from the annular row of moving blades and the further annular row of moving blades.

3. The axial flow steam turbine as recited in claim 1, wherein the outer static ring is cross-key located within the turbine casing to facilitate the limited radial movement of the outer static ring relative to the turbine casing.

4. The axial flow steam turbine as recited in claim 1, wherein the sealing device includes a plurality of sealing elements.

5. The axial flow steam turbine as recited in claim 1, wherein the sealing device is carried by the inner static ring.

6. The axial flow steam turbine as recited in claim 1, wherein the outer static ring includes an axial extension and wherein the annular row of moving blades includes a radially outer moving shroud ring element in sealing relationship with the axial extension of the outer static ring.

7. The axial flow steam turbine as recited in claim 6, wherein a further sealing device projects from the axial extension of the outer static ring towards the moving shroud ring so as to form a sealing contact with the moving shroud ring.

8. The axial flow steam turbine as recited in claim 1, wherein the sealing device includes at least one of brush seals and fin-type seals.

9. An axial flow steam turbine comprising:

(a) at least one impulse turbine stage having an annular row of static blades extending between a radially outer static ring and a radially inner static ring and an annular row of moving blades provided with blade root portions;

(b) a rotor drum having a plurality of peripherally extending slots, the blade root portions of the moving blades being held in the peripherally extending slots;

(c) a sealing device acting between the inner static ring and the rotor drum;

(d) a turbine casing surrounding the impulse turbine stage and having a recess, the outer static ring being axially located in the recess and having greater thermal inertia and greater stiffness than the inner static ring, the outer static ring being capable of a limited radial movement relative to the turbine casing so as to thereby accommodate an out-of-round distortion of the turbine casing relative to the outer static ring;

at least one reaction stage following the at least one impulse stage;

wherein the at least one impulse stage includes a plurality of impulse stages, wherein the at least one reaction stage includes a plurality of reaction stages, and wherein the impulse and reaction stages have an axially constant inner diameter that is the same as a turbine passage annulus of the steam turbine.

10. The axial flow steam turbine as recited in claim 9, wherein the impulse and reaction stages share the rotor drum.

11. The axial flow steam turbine as recited in claim 9, wherein a first diameter of the rotor drum adjacent the inner static ring of the at least one impulse stage is substantially the same as a second diameter of the rotor drum adjacent the inner static ring of the at least one reaction stage.

12. The axial flow steam turbine as recited in claim 9, wherein the at least one impulse turbine stage includes a first impulse turbine stage preceding a second impulse turbine stage, the first impulse turbine stage being a control stage including at least one steam inlet passage for directing steam onto the annular row of moving blades, and a valve element for controlling a flow of the steam.

13. The axial flow steam turbine as recited in claim 12, wherein the control stage includes a plurality of steam inlet passages, each inlet passage supplying a corresponding circumferentially extending sector of the control stage, and wherein each inlet passage has a valve for controlling a flow of steam to the corresponding sector of the control stage.

* * * * *